US012221778B2

(12) United States Patent
Sapp et al.

(10) Patent No.: US 12,221,778 B2
(45) Date of Patent: Feb. 11, 2025

(54) POP-UP SINK DRAIN ASSEMBLY WITH OVERFLOW KNOCK-OUT BLANK BAND

(71) Applicant: COMPASS MANUFACTURING INTERNATIONAL, LLC, Louisville, KY (US)

(72) Inventors: Ken Sapp, Lakeville, MN (US); DeChang Li, Maspeth, NY (US)

(73) Assignee: COMPASS MANUFACTURING INTERNATIONAL, LLC, Louisville, KY (US)

( * ) Notice: Subject to any disclaimer, the term of this patent is extended or adjusted under 35 U.S.C. 154(b) by 30 days.

(21) Appl. No.: 17/872,083

(22) Filed: Jul. 25, 2022

(65) Prior Publication Data

US 2023/0111926 A1 Apr. 13, 2023

Related U.S. Application Data

(63) Continuation-in-part of application No. 17/826,151, filed on May 26, 2022.

(60) Provisional application No. 63/231,177, filed on Aug. 9, 2021.

(51) Int. Cl.
*E03C 1/232* (2006.01)
*E03C 1/23* (2006.01)

(52) U.S. Cl.
CPC ..... *E03C 1/232* (2013.01); *E03C 1/2302* (2013.01)

(58) Field of Classification Search
CPC ..... E03C 1/14; E03C 1/20; E03C 1/22–23; E03C 1/2302; E03C 1/232; E03C 1/262
See application file for complete search history.

(56) References Cited

U.S. PATENT DOCUMENTS 4,218,785 A * 8/1980 Crawford ..... E03C 1/232 4/295
5,444,183 A * 8/1995 Gehrs ..... H02G 3/085 174/666
10,808,386 B2 * 10/2020 Beck ..... E03C 1/14
2017/0260724 A1 * 9/2017 Beck ..... A47K 1/14

* cited by examiner

*Primary Examiner* — David P Angwin
*Assistant Examiner* — Nicholas A Ros
(74) *Attorney, Agent, or Firm* — CARRITHERS LAW OFFICE, PLLC; David W. Carrithers

(57) ABSTRACT

Sinks have an integral drain overflow protection or a conventional overflow port but not both. Conventional drain assemblies have a body comprising a hollow cylinder having either solid upper body portion or an upper body sidewall portion including an opening. The present invention defines a drain assembly having an upper body sidewall portion including a knock out blank which may be left in place or knocked out for use with either type of sink. A knock-out band can be used in combination with the knock-out drain assembly body to be positioned over the knocked out body hole providing a water tight seal should the user chooses to use the knocked out drain assembly in a sink having a conventional overflow port.

11 Claims, 8 Drawing Sheets

POP-UP SINK DRAIN ASSEMBLY WITH OVERFLOW KNOCK-OUT BLANK BAND

CROSS REFERENCE TO RELATED APPLICATIONS

This application is a Continuation-In-Part of U.S. application Ser. No. 17/826,151 filed on May 26, 2022 and this application also claims priority from U.S. Provisional Application Ser. No. 63/231,166 filed on Aug. 9, 2021, all of which are incorporated by reference herein in their entirety.

TECHNICAL FIELD

The present invention relates to the field of drain assemblies for sinks.

BACKGROUND OF THE INVENTION

An overflow opening is formed in the top of the threaded portion of the drain that allows overflow water from the sink to enter the drain pipe. If the sink features an overflow, it is very important to purchase a drain with an overflow opening so that the sink and drain function properly. If the sink does not feature an overflow hole it needs to be paired with a drain without overflow.

A pop-up drain assembly is a drain with an option to seal the drain to hold water by simply pushing on it to close and to open. Pop-up drains are designed to come in two different options "with overflow" as shown in prior art FIGS. 1, 3, and 5 or "without overflow" openings as shown in prior art FIGS. 2 and 4.

Sinks and wash basins installed and used in bathrooms, kitchens, laundries and so on are always subject to overflow situations in the event that the drain lines become partially or totally clogged. A user may be unaware of the clogged drain or the incoming water may not have been turned off when a user leaves the room. In such an event, the sink will eventually overflow onto the floor and cause damage to the counter or floor.

The overflow in a sink serves two purposes, it diverts water back to the drain pipe and helps prevent water from spilling onto the counter or floor which could result in water damage. While effective, sink overflows are not designed to handle overflowing water. Water will still be rerouted to the drain, but the amount being evacuated likely won't be able to match the quantity filling the basin. Sink overflows also improve draining speed by allowing air into the piping.

Conventional sinks are fitted with overflow protection in the form of a built-in aperture defining a hole in the front or back side of the sink near the top edge of the sink, thus providing a path to drain the water which would otherwise overfill the sink and run out onto the floor. The hole carries the water down through a tunnel molded into the wall of the sink down to the sink drain. The drain pipe or drain body at the bottom of the sink which normally carries the water in the sink out to the sewer pipes in the house or building therefore must include a drain hole which allows the overflow water coming down the tunnel to escape into the same sewer pipes.

Not all sinks are fitted with the overflow holes and molded in tunnels for overflow protection. Designer sinks may be shaped of designed any a variety of configurations with no drain for aesthetic reasons. So, sinks are available in two categories, ones fitted with an extra drain overflow hole or port for at a selected elevation near the top of the sink for overflow water and sinks and bowls which do not include a drain overflow hole for an enhanced appearance.

SUMMARY OF THE INVENTION

Sinks have an integral drain overflow protection or a conventional overflow port but not both. Conventional drain assemblies have a body comprising a hollow cylinder having either solid upper body portion or an upper body sidewall portion including an opening. The present invention defines a drain assembly having an upper body sidewall portion including a knock out blank which may be left in place or knocked out for use with either type of sink. A knock-out band can be used in combination with the knock-out drain assembly body to be positioned over the knocked out body hole providing a water tight seal should the user chooses to use the knocked out drain assembly in a sink having a conventional overflow port.

In accordance with the present invention, there is provided a sink drain comprising a longitudinal cylinder having a hollow core. The drain has a lower smooth surface portion, a middle portion with exterior threads, and an upper smooth surface portion terminating with a flange. The longitudinal cylinder has a given general wall thickness of about 3 millimeters, but the knock-out blank portion integrally formed in the sidewall of the drain is slightly thinner having a thickness of about two millimeters, sometimes with an even thinner perimeter or seam, sometimes called a breaking seam of about one to two millimeters, and typically slightly less than two millimeters), to facilitate knocking out the blank forming a clean aperture or opening in the sidewall of the drain pipe. The outer surface of the drain sidewall forming the blank body is thinner than the main general drain sidewall thickness which is, for example, about three millimeters. The thinner perimeter provides for easy removal of the sidewall portion, if desired, minimizing risk of damage to the drain conduit.

The present invention is an improved drain assembly of a type having a drain pipe with a longitudinal cylinder having an upper portion terminating with a flange, the longitudinal cylinder having a selected first wall thickness, wherein the improvement consists of the longitudinal cylinder including a thinner sidewall portion having a second wall thickness defining a knock-out blank having an exterior blank surface recessed inward compared to an exterior surface of the longitudinal cylinder. A peripheral groove extends around the knock-out blank having a third wall thickness thinner than the knock-out blank providing for easy breakage and removal of the knock-out blank. A resilient removable knock-out band covers a knock-out opening formed from removing the knock-out blank providing a removable water tight seal, the knock-out band. A raised area of a corresponding shape and size of the knock-out blank is inserted into and in cooperative engagement with the knock-out overflow aperture for aligning and positioning the knock-out band over the knockout overflow aperture.

It is an object of this invention to provide a drain having a drain body which includes a knock-out blank which when removed forms an aperture in the sidewall near the upper inlet of the drain body which aligns with the overflow outlet of a given sink containing an overflow hole and an integral tunnel through which overflow water drains.

It is an object of this invention to provide a drain assembly which includes a knock-out blank which can be used in drain assemblies in sinks without overflow and in sinks which include overflow apertures and therefore require drain assemblies having an overflow aperture in the upper sidewall portion of the sink. Leaving the drain assembly knock-out blank intact forms an integral sidewall portion that provides a water tight seal for use in a sink that doesn't have overflow protection, and the integral sidewall portion knock-out blank be removed by applying enough pressure against the sidewall portion to cleanly tear away and remove the knock-out portion from the drain wall body. Thus, the drain assembly in the instant invention can be used with a sink without overflow protection or can be easily modified for use in a sink with built in overflow protection by simply popping the sidewall portion out of the drain.

It is an object of the present invention to provide an knock-out band to cover a drain assembly having a knock-out blank removed and the user wishes to use the drain assembly in a sink having a separate dedicated overflow.

It is an object of the present invention to provide a band slidable, rotatable or movable over the knock-out hole formed in a drain conduit and stretchable or at least resilient enough to slide over the drain conduit and cover the knock-out hole providing an effective water tight seal.

It is an object to provide a band which is elastic and has sufficient memory to snap back tightly over the knock-out hole providing a water tight seal.

It is an object to provide a band or "sleeve" or "ring" comprising a thin, preferably flat band having dimensions sufficient to allow the width of the band to cover the knock-out opening when positioned there over forming a water tight seal.

It is an object of the present invention to provide a band including a raised area which fits in and cooperatively engages the knock-out hole to provide a tighter fitting seal and easy alignment and improve in proper positioning of the band over the knock-out opening.

It is another object to provide a band which can be rotated around the outer surface of the cylindrical drain body and/or can slide up or down or turned over to cover or uncover the knock-out hole.

It is another object of the present invention to provide a band for covering one or more knock-out holes aligned horizontally in the side wall of a drain assembly.

It is another object of the present invention for a knock-out band to include at least one raised portion which corresponds in size and shape to the knock-out blank opening.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
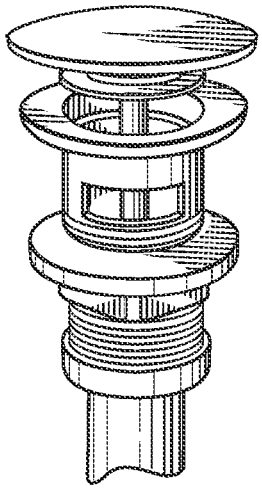
FIG. 1 PRIOR ART
FIG. 1 shows a drain assembly with an overflow.
Figure 2:
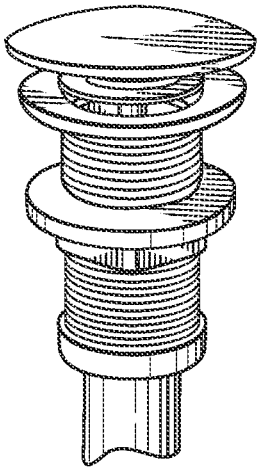
FIG. 2 PRIOR ART
FIG. 2 shows a drain assembly with no overflow.
Figure 3:
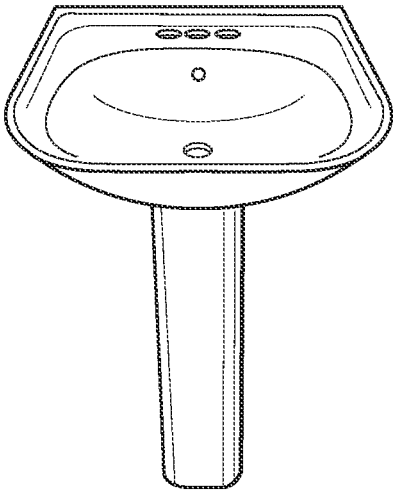
FIG. 3 PRIOR ART
FIG. 3 shows a sink with an overflow.
Figure 4:
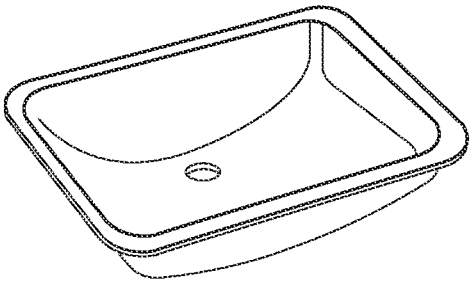
FIG. 4 PRIOR ART
FIG. 4 shows a sink with no overflow.

In accordance with the present invention, there is provided a drain assembly having a knock-out blank providing an drain assembly for use in sinks with or without a drain overflow together with a knock-out band to cover a hole formed from a knock-out blank in order for the drain assembly to be re-purposed for a sink including a drain overflow.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The term knock-out band is synonymous with a knock-out sleeve or knock-out ring.

The term knock-out blank is synonymous with knock-out tab.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Example embodiments will now be described more fully with reference to the accompanying drawings.

In accordance with the present invention, there is provided a push-pull drain assembly for use with a conventional sink having an opening in the sink body affording overflow protection or a drain assembly including an opening in the drain tube for overflow protection. Overflow protection in a sink provided with an overflow opening includes an aperture or hole 5 formed near to the top of the sink wall and in the inner sidewall of the sink body leading to a conduit or tunnel within the sink wall which carries the water to the bottom area of the sink. Some sinks may also be cast having an inner and outer shell whereby water flows between the linings to the drain.

Figure 5:
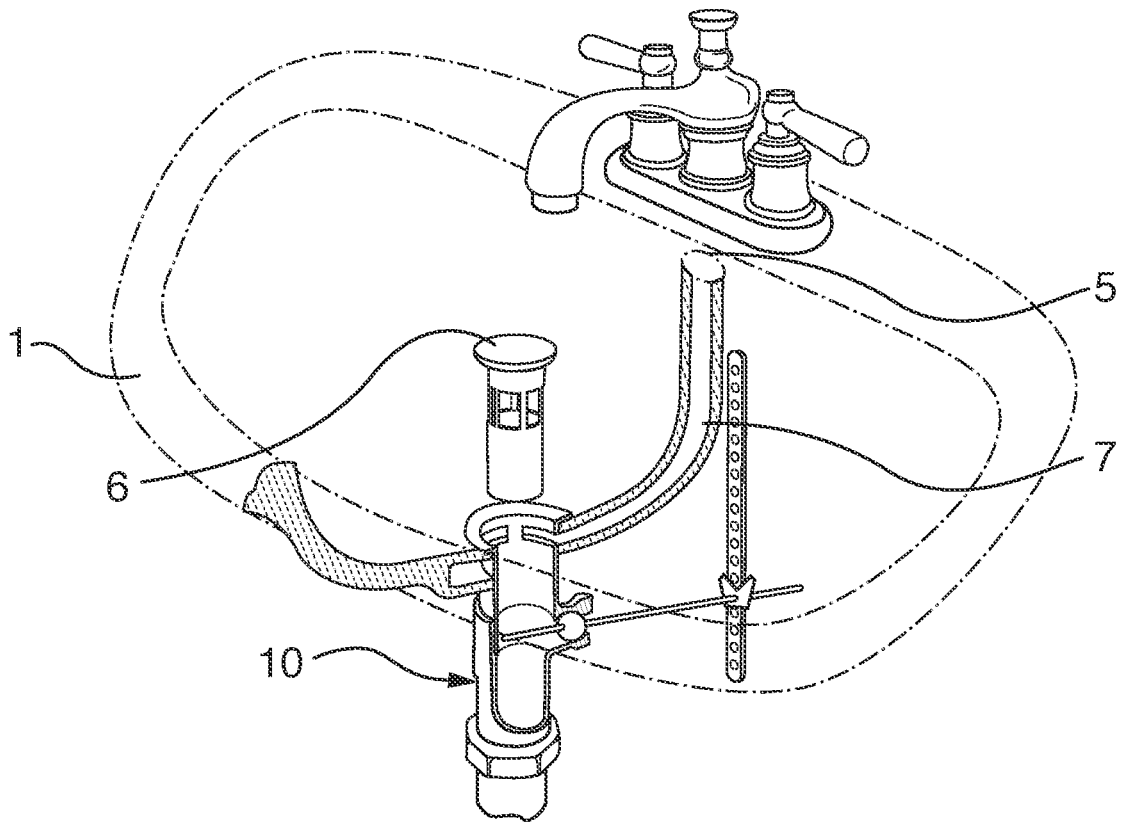
FIG. 5 PRIOR ART
FIG. 5 is a perspective view of a sink with an overflow drain assembly.
Figure 6:
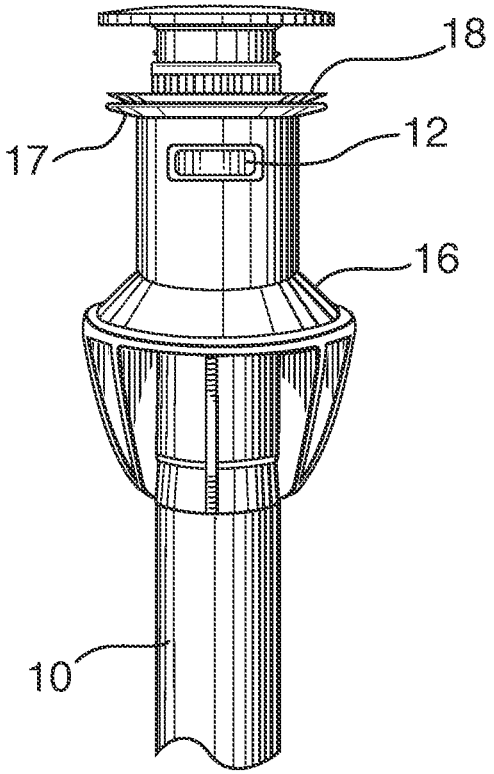
FIG. 6 is a front view of a drain assembly with an overflow aperture covered by an integral knock-out blank.
Figure 7:
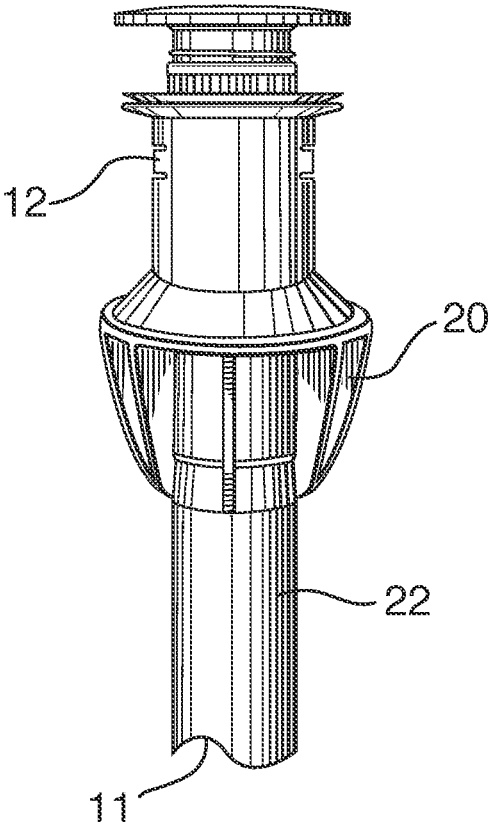
FIG. 7 is a side view of the drain assembly of FIG. 6 showing the knock-out blank.
Figure 8:
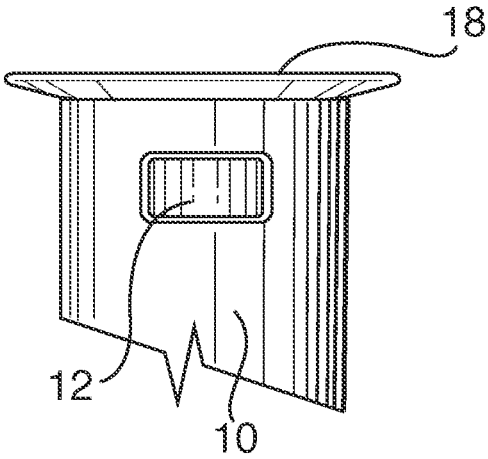
FIG. 8 is a front view of the upper portion of the drain tube of FIG. 6 showing the knock-out blank.

In FIG. 5, it can be seen that the overflow aperture 14 is in alignment with the opening of the tunnel 7 at the bottom of the sink 1 and is captured between the flange gasket 17 and the rubber washer 16 so that overflow water is forced to drain out of the tunnel 7, through the overflow aperture 14, and out of the bottom aperture 11 of the sink drain assembly 10. It is anticipated that the overflow aperture 14 and thus, the sidewall portion 12 is about one quarter inch to three eighths of an inch high by about three to five quarters of an inch wide and is centered about one half inch below the flange 18. Further, a second overflow aperture 14 and sidewall portion 12 may be provide on the opposite side of the sink drain assembly 10 if desired.

The sink 1 shown in FIG. 5 includes a molded-in integral drain tunnel 7 which carries overflow water spilling into the overflow hole 5 of the sink 1. The tunnel 7 resides in the space between the outer wall and the inner wall in the sidewall of the sink. Because this sink contains the overflow prevention comprising a hole 5 in the wall near the top of the sink leading into the tunnel 7 and on to the sink drain assembly 10, the drain must include a opening requiring plumbers or manufacturers to provide separate kits for sinks with and without overflow holes. If the water level in the sink rises above the overflow hole in the sink, that water will flow through the overflow hole 5 and drain down through the tunnel 7 to the bottom of the sink and through the overflow aperture 14 and out the bottom aperture 11 of the drain 10.

Many bathroom sinks are supplied with a pop up drain plug which is operated by raising or lowering a vertical rod which is rotatably connected to a horizontal rod which is rotatably attached to the drain assembly and to an inner drain plug and is also provided with a removable sidewall portion 12 which can be removed, leaving an overflow aperture 14 as has been provided in the drain assembly 10 described above.

The knock-out blank of the instant invention provides a means for providing a single drain which can be easily modified on site to be used in a sealed drain or drain having an overflow port. The sidewall portion defining a knock-out blank or tab 12 can be removed without special tools by snapping that portion away from the upper sidewall portion 103 of the sink drain assembly 10. A linear rod or tools such as the shank of a screwdriver can be biased or pressed against the knock-out blank 12 which is shaped as a oval or rectangle having rounded corners. Thus removal of the sidewall portion knock-out blank 12 from the drain sidewall 22 can be accomplished by placing a portion of a tool, such as the shaft of a screwdriver 6, against the sidewall portion and pressing the portion 12 into the drain 10 until the portion 12 is broken free from the drain 10.

Figure 9:
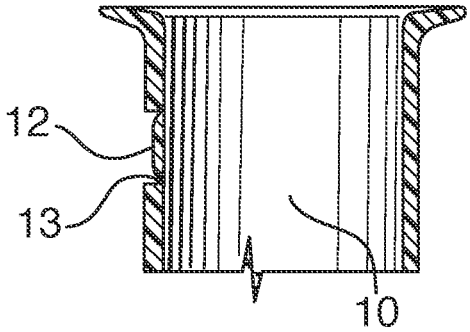
FIG. 9 is a side view of the upper portion of the drain tube sidewall of FIG. 6 showing the knock out blank having a lower profile to prevent tool movement during removal of the blank and showing the seam around the knock-out blank having a thinner thickness than the blank.
Figure 10:
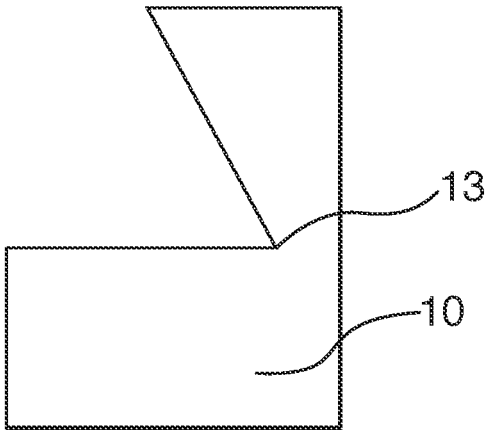
FIG. 10 is a side view of the drain tube showing the break lines of the removable blank portion of the sidewall of the drain of FIG. 6 and showing the wall thickness of the knock out blank wall thickness 0.2 mm versus the drain wall thickness of 0.3 mm with the break lines to facilitate clean removal of the blank from the drain sidewall.
Figure 11:
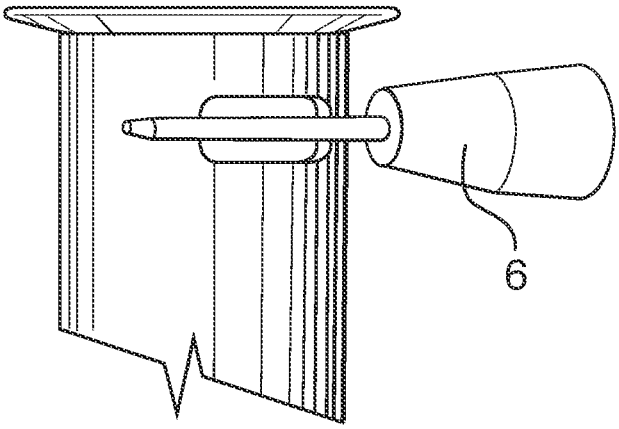
FIG. 11 is a front view of the upper portion of the drain tube of FIG. 6 showing a tool being pressed against the removable knock-out blank portion of the drain tube sidewall to remove the knock-out blank.
Figure 12:
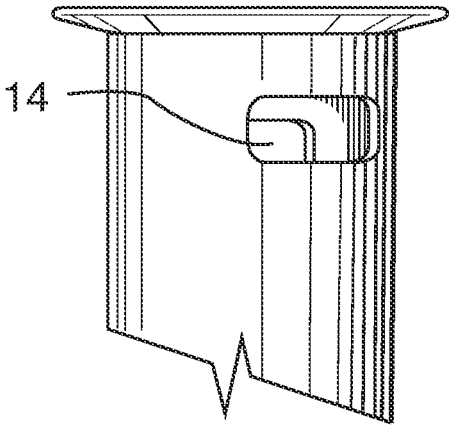
FIG. 12 is a front view of the upper portion of the drain tube sidewall of FIG. 6 showing the resulting drainage aperture which exists after the knock-out blank portion has been removed.
Figure 13:
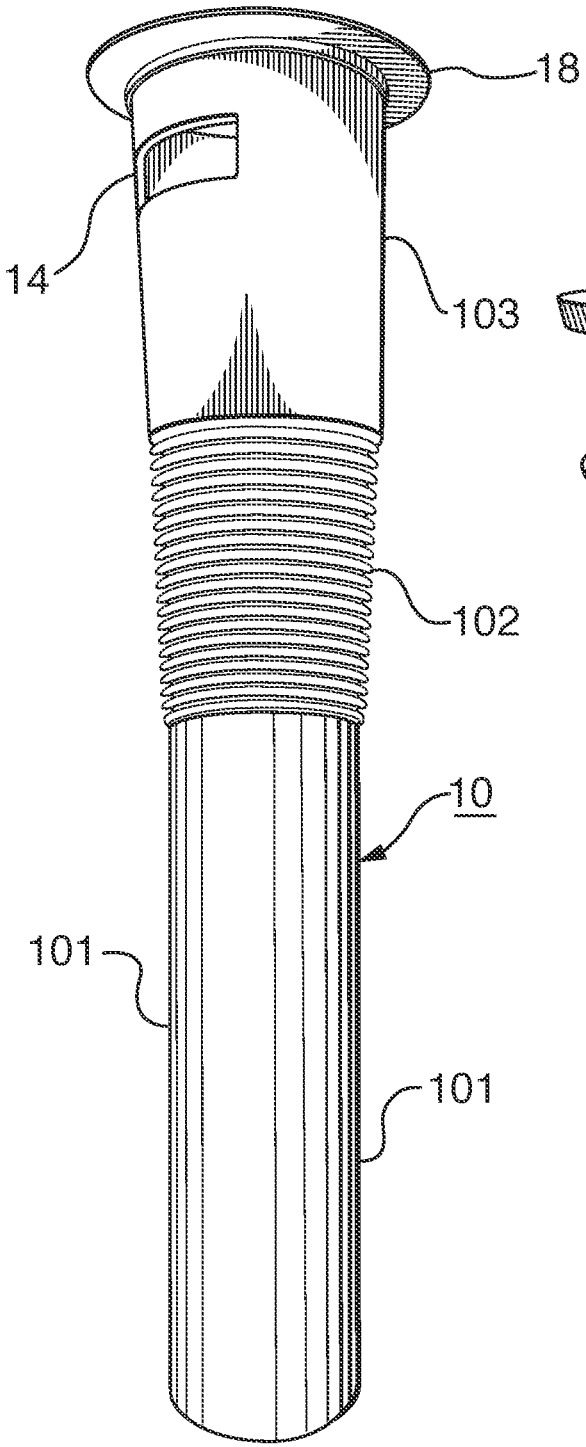
FIG. 13 is a perspective view of the drain tube or "drain conduit" having an upper portion showing a knock out aperture after removal of the tab, a medial threaded portion for threadably engaging the nut, and a lower conduct portion.

The knock-out blank 12 is integrally formed in the sidewall 22 of the cylindrical sink drain assembly 10 so that each have a smooth inner wall surface, but the outer exterior surface of the drain knock-out blank 12 is recessed inward an effective depth of about 1 millimeter so that the exterior surface of the drain sidewall 22 extends outward further than the knock-out blank 12. Thus, the knock-out blank 12 has a lower side profile than the drain sidewall 22 as shown best in FIGS. 9 and 10. The lower profile helps position the tool and prevent it from moving during the procedure to pry open or break the knock-out blank away from the sidewall 22 of the drain 10.

The longitudinal cylinder forming the drain tube sidewall has a given general wall thickness of about 3 millimeters and the knock-out blank 12 has a thickness of about two millimeters with an even thinner perimeter or seam forming a groove about one to two millimeters, and typically less than two millimeters in thickness, to facilitate knocking out forming a clean aperture. The blank body 12 should always be thinner than the main general drain wall thickness to provide for easy removal of the sidewall portion, if desired, minimizing risk of damage to the drain conduit.

The sidewall blank 12 is connected to the drain 10 by a thin wall portion 13 around the perimeter of the sidewall portion. It is anticipated that the drain 10 may comprise a thermoplastic or other plastic, or composite material as well as a metallic substance. Where a thermoplastic is used, a general wall thickness may be about two millimeters or more and the thin wall portion may be around three tenths of a millimeter to provide an easily removable sidewall portion which can otherwise be left intact and will provide for water tight fluid drainage. This thin wall connection makes the breaking and removal of the sidewall portion an easy task to perform. The sidewall portion forming the knock-out blank 12 may then be discarded. This provides the sink drain assembly 10 with an avenue to get rid of overflow water in the sink 1. The overflow water is carried down to the bottom of the sink and drains through the overflow aperture 14 formed in the sidewall 22 of the drain 10 by removal of the knock-out blank 12.

The sink drain assembly 10 comprises a longitudinal cylinder 22 having a hollow core and containing a lower smooth surface portion 101, a middle threaded portion 102, and an upper smooth surface portion 103 terminating with a flange 18. A flange gasket 17 is installed onto the sink drain assembly 10 just under the flange 18. The sink drain assembly 10 is inserted downward through the drain hole in the bottom of a sink 1. A rubber washer 16 is then installed onto the sink drain assembly 10. Next the nut 20 is threaded onto the threaded portion 102 until the nut tightly compresses the rubber gasket 16 and the flange gasket 17 against the sink drain flange 18 forming a water tight seal.

It is anticipated that the overflow aperture 14 and thus, the sidewall portion 12 is about one quarter inch to three eighths of an inch high by about three to five quarters of an inch wide and is centered about one half inch below the flange 18.

In the event that a user is installing a sink without overflow prevention, there is no overflow aperture in the sink and no drain tunnel 7. In this event, there is no need to remove the sidewall knock-out blank 12, and, in fact, the sidewall portion forming the blank 12 must be left intact to prevent any leakage do to the different sink construction. FIGS. 6-9 show portions of another drain assembly wherein the sidewall portion forming the blank 12 has not been removed but remains as an integral part of the sink drain assembly 10 blocking the overflow aperture 14.

Figure 14:
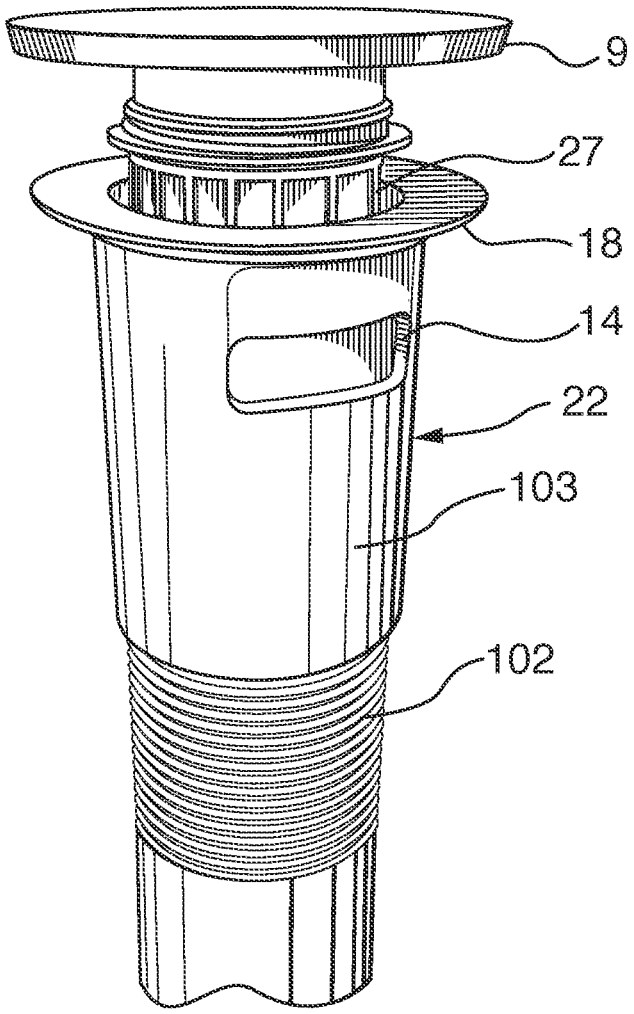
FIG. 14 is a perspective view of the drain assembly of FIG. 13 including a drain assembly cover having a strainer basket disposed around the stem below the lid cover for staining fluid entering the drain.
Figure 15:
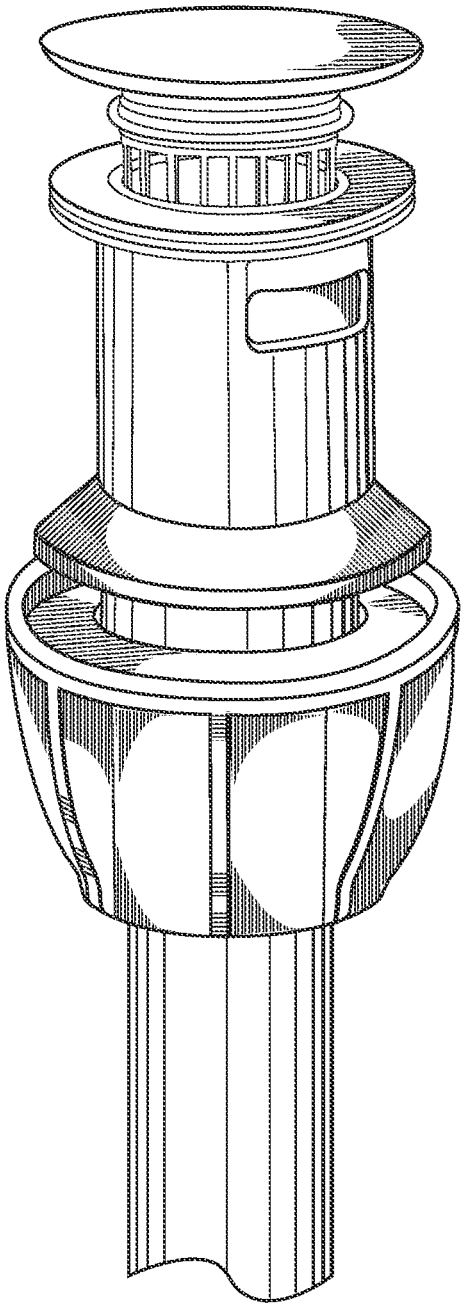
FIG. 15 is a perspective view of the drain assembly of FIG. 10 including a nut and seal affixed thereto and a drain plug having a strainer basket disposed around the stem below the lid for staining fluid entering the drain assembly.
Figure 16:
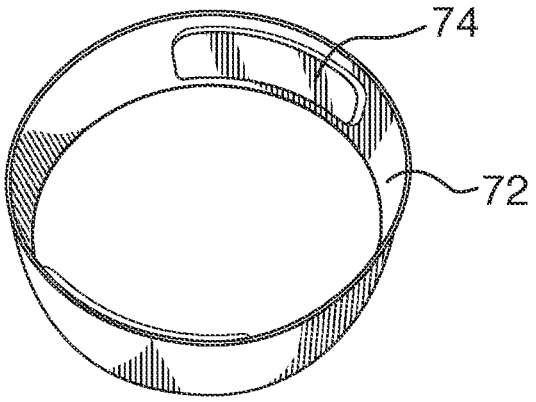
FIG. 16 is a perspective view of a knock-out band showing the raised area on the inner surface of the band sized and shaped to fit a corresponding knock-out hole in a sidewall of a drain assembly tube.
Figure 17:
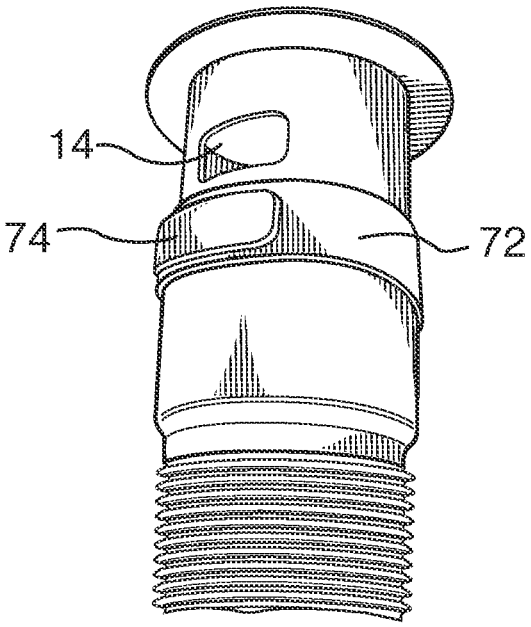
FIG. 17 is a perspective view of a drain tube with a knock-out band positioned below the knock-out hole in the side wall.
Figure 18:
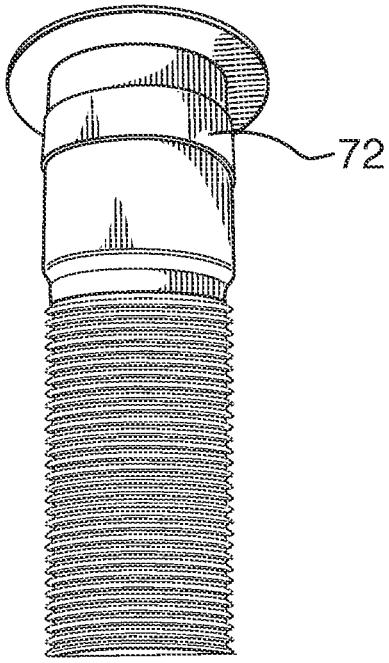
FIG. 18 is a perspective view of a drain assembly with a knock-out band covering the knock-out hole.

A drain assembly is shown in FIGS. 11-15, 17, and 19-20 with a sidewall portion defining a tab or knock-out blank 12 which has been removed and the overflow aperture 14 is left near the flange 18. FIGS. 14-15 show a drain cover 9 having a strainer basket 27 disposed around the stem below the cover for staining fluid entering the drain. A nut threadably engages the threaded portion of the drain body whereby the nut secures the drain body against one or more seals provided by o-rings or flexible gasket material provides a water tight seal.

As shown in FIGS. 16-18 and 20, a knock-out band 72 can be used to cover a overflow aperture 14 in a sink drain assembly 10. The sink drain assembly 10 may be supplied with a cooperatively engaging water tight knock-out band 72 covering the knock-out aperture 14 opening providing means for a single sink drain assembly 10 to be purchased and used for sinks with and without overflows. The knock-out band 72 may be used to cover overflow aperture 14 in drain assemblies where the user wishes to use the drain assembly in a sink without an overflow. The knock-out band 72 is movable (slidable up or down the drain tube) and (rotational with respect to the drain tube), and preferably slidable over the drain conduit and stretchable or at least resilient enough to slide over the drain conduit and over the hole forming the overflow aperture, Preferably the band is elastic and has sufficient memory to snap back tightly over the knock-out hole providing a water tight seal. The band or "sleeve" 72 may be formed as an o-ring or preferably a thin, flat band having dimensions sufficient to allow the width of the band to cover the knock-out opening when positioned there over. In one preferred embodiment the band includes a raised area 74 which fits in and cooperatively engages the knock-out aperture 14 to provide a tighter fitting seal and easy alignment and improve aid in proper positioning of the band 72 over the overflow aperture 14 opening. Typically, a sink drain assembly 10 would include at least one and preferably two opposing knock-out blanks 12 and potentially could include multiple knock-out openings, therefore a band 72 would include corresponding sized and shaped raised areas 74 to align and seal each knocked out overflow aperture 14.

In a preferred embodiment a ridge line may optionally be formed above and below the knock-out opening or an indentation or reduced diameter section may be used to align and abut the outer edges of the band to aid in holding the band in position over the knock-out opening.

The removable band may slidable or stretchable and comprise a polymer, elastomer, rubber, or combinations thereof having sufficient elasticity to be stretched over the knock-out port and provide a water tight seal.

Figure 19:
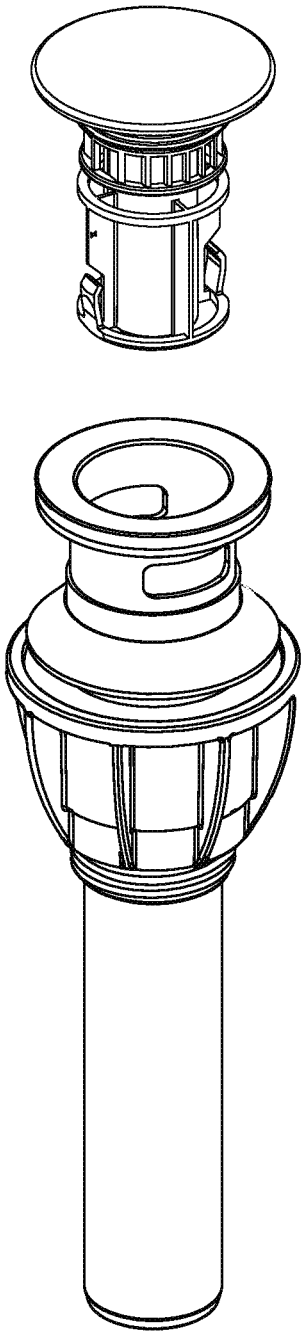
FIG. 19 is an exploded view showing the cap, screen, and actuator assembly aligned with the drain assembly tube having a knocked out blank or panel.
Figure 20:
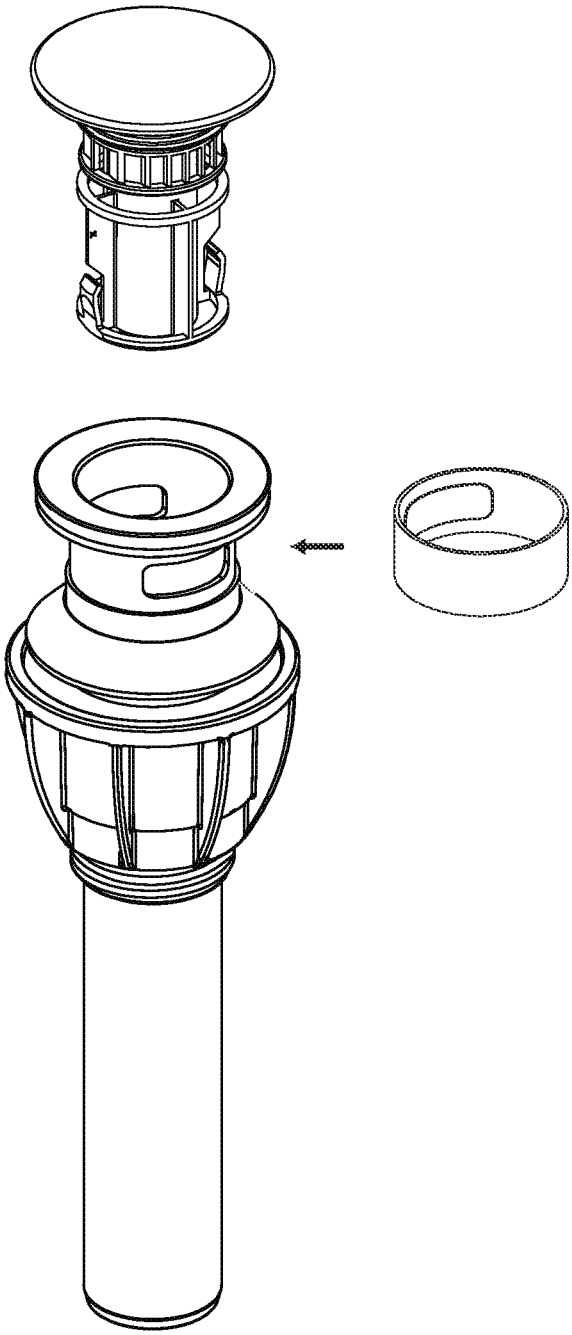
FIG. 20 is an exploded view of a drain assembly showing the cap, screen, and actuator assembly aligned with the drain tube having a pair of opposing knocked out panels and showing a water tight knock-out band having a raised portion on the inside surface of the band of cooperative size and shape to fit a knock out opening upon alignment therewith.

FIGS. 14-15 and 19-20 show a drain cover having a strainer basket disposed around the stem below the lid for staining fluid entering the drain. A nut threadably engages the threaded portion of the drain assembly body whereby the nut secures the drain assembly body against one or more seals provided by o-rings or flexible gasket material provides a watertight seal. The push pull drain assembly actuator includes expansion tabs for cooperative engagement with the inner side walls of the drain tube for retaining the drain assembly in position via a friction fit. FIG. 19 shows the portion of the drain tube above the threaded section as a collar having a pair of opposing knock-out overflow aperture holes, and FIG. 20 shows a knock-out band 72 of corresponding size and shape having a raised portion for alignment and positioning of the knock-out band 72 with the knock-out overflow aperture 14.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

We claim:

1. An improved drain assembly of a type having a drain pipe with a longitudinal cylinder containing a lower unthreaded portion, a middle portion with exterior threads, and an upper unthreaded portion terminating with a flange, said longitudinal cylinder having a selected first wall thickness, the improvement consisting of:

said longitudinal cylinder including at least one thinner sidewall portion having a second wall thickness defining a knock-out blank having an exterior blank surface recessed inward compared to an exterior surface of said longitudinal cylinder, and a peripheral groove around said knock-out blank having a third wall thickness thinner than said knock-out blank providing for easy breakage and removal of said knock-out blank; and a resilient removable knock-out band for covering a knock-out overflow aperture formed from removing said knock-out blank providing a removable water tight seal.

2. The sink drain assembly defined in claim 1, wherein said longitudinal cylinder includes a plurality of knock-out blanks and said resilient removable knock-out band is configured to cover a plurality of knock-out overflow apertures formed from removing said plurality of knock-out blanks.

3. The sink drain assembly defined in claim 1, wherein said longitudinal cylinder includes a ridge line formed above and below said knock-out blank to align and position said knock-out band over said knock-out overflow aperture.

4. The improved drain assembly of claim 1, said knock-out band including a raised area of a corresponding shape and size of said knock-out blank for insertion into and cooperative engagement with said knock-out overflow aperture and for aligning and positioning said knock-out band over said knock-out overflow aperture.

5. The sink drain assembly defined in claim 4, wherein said knock-out blank is elongated with respect to a horizontal axis.

6. The sink drain assembly defined in claim 4, wherein said knock-out blank is elongated with rounded corners.

7. The sink drain assembly defined in claim 6, wherein said knock-out blank is elongated with rounded corners and curved to correspond to a curvature of said longitudinal cylinder.

8. An improved drain assembly of a type having a drain pipe with a longitudinal cylinder having an upper portion terminating with a flange, said longitudinal cylinder having a selected first wall thickness, the improvement consisting of:

said longitudinal cylinder including at least one thinner sidewall portion having a second wall thickness defining a knock-out blank having an exterior blank surface recessed inward compared to an exterior surface of said longitudinal cylinder, and a peripheral groove around said knock-out blank having a third wall thickness thinner than said knock-out blank providing for easy breakage and removal of said knock-out blank;

a resilient removable knock-out band for covering a knock-out opening formed from removing said knock-out blank providing a removable water tight seal, said knock-out band including a raised area of a corresponding shape and size of said knock-out blank for insertion into and cooperative engagement with said knock-out overflow aperture and for aligning and positioning said knock-out band over said knockout overflow aperture.

9. The sink drain assembly defined in claim 8, wherein said longitudinal cylinder includes a ridge line formed above and below said knock-out blank to align and position said knock-out band over said knock-out overflow aperture.

10. The sink drain assembly defined in claim 8, wherein said knock-out blank is elongated with rounded corners and curved to correspond to a curvature of said longitudinal cylinder.

11. The sink drain assembly defined in claim 8, wherein said longitudinal cylinder includes a plurality of knock-out blanks and said resilient removable knock-out band is configured to cover a plurality of knock-out overflow apertures formed from removing said plurality of knock-out blanks.

* * * * *